United States Patent [19]

Monfort

[11] Patent Number: 4,502,657

[45] Date of Patent: Mar. 5, 1985

[54] HOLDER OF SHEET MUSIC

[76] Inventor: Archie Monfort, 7500 Moon Rd., Columbus, Ga. 31904

[21] Appl. No.: 259,947

[22] Filed: Jul. 7, 1981

[51] Int. Cl.[3] ..... A47B 97/04

[52] U.S. Cl. ..... 248/451

[58] Field of Search ..... 248/309 R, 364, 451, 248/452, 453, 500

[56] References Cited

U.S. PATENT DOCUMENTS

| | | | |
|---|---|---|---|
| 160,044 | 2/1875 | Wilson | 248/451 |
| 475,126 | 5/1892 | Lorenz | 248/453 |
| 582,140 | 5/1897 | Nolan | 248/452 |
| 634,922 | 10/1899 | Waldrip | 248/452 |
| 2,570,439 | 10/1951 | Forca | 248/452 |
| 2,583,207 | 1/1952 | Buck | 248/309 R |
| 2,642,603 | 6/1953 | Mills | 248/309 R |
| 3,677,510 | 7/1972 | Kenwell | 248/441 R |
| 4,325,484 | 4/1982 | Berry | 248/309 R |

*Primary Examiner*—William H. Schultz

*Attorney, Agent, or Firm*—Patrick F. Henry

[57] ABSTRACT

A flat support has sheet music supported with the opposed pages movable from one side to the other and vice versa and a brush-like member is mounted in front of and across the music whereby the individual brush members may engage and prevent the pages from accidentally turning. The brush-like arrangement is pivotally mounted for movement but normally biased by weight means toward the pages whereby upon turning the pages manually the brush members are moved out of the way but return without manual assistance.

7 Claims, 3 Drawing Figures

HOLDER OF SHEET MUSIC

BACKGROUND OF THE INVENTION

1. Field of the Invention

Support for sheet music, books, and the like, having flexible members like brush bristles supported to be engaged by the sheets and biased for movement back into position after movement.

2. Description of the Prior Art

The usual method of holding a book on a support or sheet music on a music stand or rack is to use some type of movable clamping means such as found in U.S. Pat. No. 457,564. More elaborate devices for the physically infirm are found in U.S. Pat. No. 3,677,510. Such arrangements have obvious disadvantages such as the difficulty while the hands are occupied involved in moving from one page to another and repositioning the means which holds the pages in place plus the cost of the device. There is a need for an inexpensive arrangement which holds the pages of a book or sheet music in position temporarily but allows free and easy repositioning without manipulating the means or arrangement which temporarily retains the pages whereby the operator only has to turn the pages and not bother with the mechanism.

SUMMARY OF THE INVENTION

A support for sheet music, book, or the like, is angled to the proper position to support the sheets in open position for turning from one page to the other as when reading the book or the sheets of music and there is a sheet retaining means comprising a plurality of flexible members arranged about a centerline like a brush which extends for a length along the width of the sheets so as to hold both of the facing sheets in position and is movably mounted to be moved away from the sheet upon contact by the sheet when the sheet is manually moved from one side to the other, and means is provided on said retainer to return same to position when released by the sheet and to provide the desired amount of pressure of the flexible members against the sheet.

Accordingly, the main object of this invention is to gently and releasably hold the pages of an open sheet music or book in place and position temporarily and then to release pressure on the sheet when the sheet is manually moved from one position to another and to return by itself in contact with the sheet.

Other and further objects and advantages of this invention will become apparent upon reading the following description of a preferred embodiment in conjunction with the accompanying drawings.

DESCRIPTION OF A PREFERRED EMBODIMENT

Figure 1:
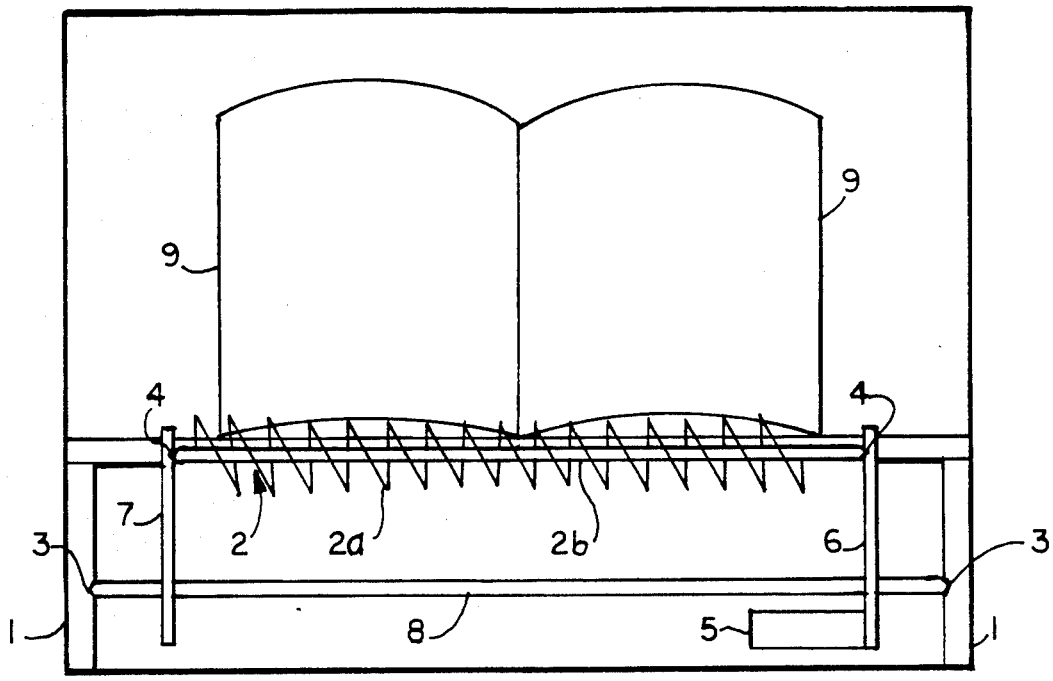
FIG. 1 is a perspective view of the present holder showing sheet music in position for reading by a musician prior to turning to another page.
Figure 2:
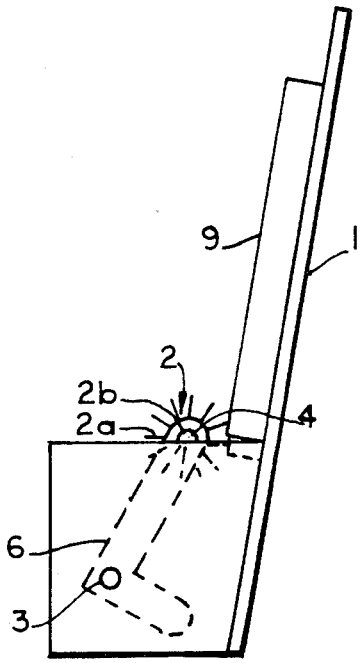
FIG. 2 is a side elevation view of the device shown in FIG. 1.
Figure 3:
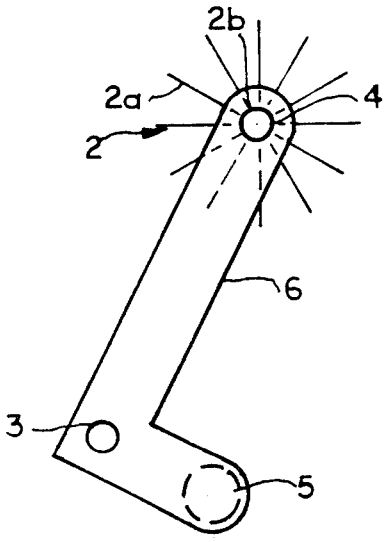
FIG. 3 is an end elevation view of the sheet engaging part of the device in FIGS. 1 and 2 with other details omitted.

The support 1 comprises a substantially flat surface such as a sheet of plastic, plywood and the like, upon which the sheet music or book is supported. A cylindrical brush 2 comprises flexible brush bristle members 2*a* extending outwardly and radially in different directions from a center longitudinal core or shaft 2*b* supported for rotational movement in a pivot bearing arrangement 4 (one of two pivot bearing arrangements 3, 4) at each respective end whereby the entire brush 2 will rotate whenever the bristle members 2*a* are touched as by pushing thereagainst in a direction to cause rotary movement in bearing arrangement 4 which are supported so that the brush 2 is engaged and biased under pressure against the holder 1 by means of a weight 5 which is a length of bar or shaft carried on a support arm 6 which supports one end of shaft 2*b* in the bearing assembly 4 and the other end of shaft 2*b* is supported in a similar bearing assembly 4 on a support arm 7. Support arms 6 and 7 are both attached to a pivot axle shaft 8 having the ends thereof supported in the bearing assemblies 3.

In the operation of the device, normally the pages 9 of the sheet music or book, in facing opposed relationship on holder 1, in the manner shown in FIG. 1, are held in place by the gentle but effective pressure of the individual bristle members 2*a* under the preselected pressure of the counter weight 5 and the movement of one of the pages 9 from one side to the other which occurs when reading a book or changing sheet music the rotary brush 2 will rotate to permit the page 9 to move into position and if the pressure is sufficient the rotary brush 2 is lifted up and away from the face of the holder 1 and music 9. When the pages of the music 9 are turned by hand, the rotary brush 2 is lifted up and away from the lower section of the music 9. This movement of the brush 2 away from the music 9 is allowed because the supporting arms 6 and 7 which are fastened to the pivot axle 8 swing out toward the operator or musician. Upon release of a page of the music 9 the brush 2 is brought to its normal place of pressure on the music 9 by the pressure of the counter-balance weight 5. The brush 2 has a reduced diameter in the center section which provides for easier turning of the pages.

While I have shown and described a particular embodiment of the invention together with a suggested mode of operation this is by way of illustration only since there are various alterations, changes, deviations, revisions and departures which may be made in the preferred embodiment without avoiding the scope of the invention as defined only by a proper interpretation of the appended claims.

What is claimed is:

1. In a holder for supporting sheet music, books or the like having opposed pages which are movable from one side to the other and vice versa:

a support for the sheet music, books and the like which supports said pages in flat, opposed relationship for turning from one side to the other and vice versa, a plurality of individual page retaining members arranged on said support transversely in front of and across said pages for temporarily retaining said pages by preventing said pages from turning, movable support means for said individual page retaining members supporting said members for movement toward and away from the sheet whereby movement of the sheet against said members, such as manual turning of said papers, causes said members to move away from said page temporarily to release any pressure on said page so that said pages can move, means on said support means biasing said support means and said individual members toward said pages for return of said members to position against said pages after movement therefrom, said individual members being like the individual bristles of a cylindrical brush and the support means comprising the longitudinal center of the brush.

2. The device in claim 1 wherein said page returning members are supported on respective end support members on said support.

3. In a holder for supporting sheet music, books or the like having opposed pages which are movable from one side to the other and vice versa:

a support for the sheet music, books and the like which supports said pages in flat, opposed relationship for turning from one side to the other and vice versa, a plurality of individual page retaining members arranged on said support transversely in front of and across said pages for temporarily retaining said pages by preventing said pages from turning, movable support means for said individual page retaining members supporting said members for movement toward and away from the sheet whereby movement of the sheet against said member, such as manual turning of said papers, causes said members to move away from said page temporarily to release any pressure on said page so that said pages can move, means on said support means biasing said support means and said individual members toward said pages for return of said members to position against said pages after movement therefrom, said movable support means comprising a longitudinal shaft having the ends thereof supported on respective movable support members, and a second longitudinal shaft having the ends thereof supported for rotation on said holder, said support members being attached to said second longitudinal shaft.

4. The device in claim 1, said means biasing being weight means attached to one of said movable support members.

5. In a holder for supporting sheet music, books or the like having opposed pages which are movable from one side to the other and vice versa:

a support for the sheet music, books and the like which supports said pages in flat, opposed relationship for turning from one side to the other and vice versa, a plurality of individual page retaining members arranged on said support transversely in front of and across said pages for temporarily retaining said pages by preventing said pages from turning, movable support means for said individual page retaining members supporting said members for movement toward and away from the sheet whereby movement of the sheet against said members, such as manual turning of said papers, causes said members to move away from said page temporarily to release any pressure on said page so that said pages can move, means on said support means biasing said support means and said individual members toward said pages for return of said members to position against said pages after movement therefrom, said movable support means comprising a first longitudinal support member having said individual page retaining members projecting outwardly therefrom, second opposed support members supporting opposite ends of said first longitudinal support member, and a third support member supporting said second opposed support members thereon and having opposite ends thereof pivotally supported on said support for the sheet music, books and the like.

6. The device in claim 5 wherein said means biasing is a weight means attached to one of said second support members for counter-balancing said first support member.

7. The device claimed in claim 6 wherein said individual members are like the individual bristles of a cylindrical brush and the support means comprises the longitudinal center of the brush.

* * * * *